US007343728B1

(12) United States Patent
Cundari

(10) Patent No.: US 7,343,728 B1
(45) Date of Patent: Mar. 18, 2008

(54) CHAIN TOOL

(75) Inventor: Daryl Cundari, Adelanto, CA (US)

(73) Assignee: ZipTy Racing, Inc., Hersperia, CA (US)

( * ) Notice: Subject to any disclaimer, the term of this patent is extended or adjusted under 35 U.S.C. 154(b) by 0 days.

(21) Appl. No.: 11/748,302

(22) Filed: May 14, 2007

(51) Int. Cl.
*B21L 21/00* (2006.01)

(52) U.S. Cl. ..... 59/7; 59/35.1; 81/3.27

(58) Field of Classification Search ..... 59/7, 59/8, 35.1; 29/229; 81/426.5, 8.1, 3.27
See application file for complete search history.

(56) References Cited

U.S. PATENT DOCUMENTS 2,577,193 A * 12/1951 Imse ..... 59/7
3,854,282 A * 12/1974 Mazel ..... 59/7
3,903,688 A * 9/1975 Robinson ..... 59/7
3,937,005 A * 2/1976 Becker ..... 59/7
4,030,286 A * 6/1977 Gibilaro ..... 59/7
4,433,462 A * 2/1984 Stratton ..... 29/229
5,193,336 A * 3/1993 King ..... 59/7
5,203,158 A * 4/1993 Bowers ..... 59/7
5,870,811 A * 2/1999 Ciok ..... 29/229

* cited by examiner

*Primary Examiner*—David B Jones
(74) *Attorney, Agent, or Firm*—Black, Lowe & Graham, PLLC

(57) ABSTRACT

A tool for aiding master link removal from a chain. The master link includes two pins and a clip with two ends extending from one pin to the other. The chain includes plates, pins, and rollers. The chain has a longitudinal direction along the length of the chain. The tool includes a support member, a plurality of coupler legs, and two pry posts. The coupler legs extend from the support member and are sized to fit between adjacent chain rollers. The legs, combined with the support member, bridge across the master link to hold it secure relative to the pry posts. The pry posts extend from the support member laterally offset from the coupler legs. The pry posts are generally laterally adjacent the ends of the clip when the coupler legs are secured to the chain.

15 Claims, 4 Drawing Sheets

CHAIN TOOL

FIELD OF THE INVENTION

This invention relates generally to mechanic's tools and, more specifically, to a tool for use with a roller type chain.

BACKGROUND OF THE INVENTION

Roller type chains are used in various motorized and non-motorized mechanical applications for transmitting power from one shaft to another via sprockets and the roller type chain. Such chains may be used on stationary mechanical equipment or in vehicles such as automobiles, bicycles, and motorcycles. In many common applications the chain is removable from the sprockets to which it is attached by removal of a master link. The master link includes side plates and pins coupled with a clip to hold the side plates in place on the pins. The pins are secured through opposing chain links to close a chain a chain and complete the connection of the chain to a plurality of sprockets on which it moves. The master link is removed by popping the clip off of the master link pins, which include recesses in the ends thereof on to which the clip is secured. The clip is C-shaped with one open end that is biased to a closed position to be well secured onto one of the master link pin recesses. The clip is typically removed with either pliers or a flat head screwdriver by pushing the open end of the clip off of the pin over which it is secured. As the clip is forced in the direction of its closed end (in a direction parallel to the longitudinal direction of the chain,) the clip resiliently opens enough to pop off the pin and allow its removal.

However, this can be a difficult operation as the screwdriver will often slip off of the end of the clip during the attempt or the clip will pop off with a spring loaded force that will cause it to become separated from the chain and potentially lost. The small region in which the screwdriver must be inserted does not add to the ease of clip removal. A slip of the screwdriver can also injure the person attempting clip removal.

Clip removal with pliers is likewise difficult because of the small places for purchase of the plier-jaws. Furthermore, the movement of the chain, especially when not adjacent a sprocket, makes the task more difficult.

Insertion of the master link and clip involves similar difficulties. The closed end of the clip must be placed over the end of one of the pins and then pushed forward such that the open end of the clip is sprung over the other of the pins. This is also done typically with a screwdriver or pliers. Typically, numerous attempts must be made before success.

SUMMARY OF THE INVENTION

The present invention provides a tool to make the task of master link insertion or removal simple and safe. The tool is also small, easy to handle, and relatively inexpensive. The tool includes a support member, a chain coupler, and a pry member. The chain coupler extends from the support member. The coupler is securable to the chain adjacent the master link. The pry member is also held by the support member. It is laterally offset from the chain coupler to be generally adjacent one end of the clip when the coupler is secured to the chain.

In accordance with another aspect of the invention, the coupler includes securement members adapted to bridge the master link. Thus, the chain is coupled on both sides of the master link by the securement members to help maintain the alignment of the tool with the chain and the proper positioning of the pry member. In one preferred embodiment, the coupler includes outer legs insertable in the chain adjacent the chain pins on either side of the master link. Thus, the coupler bridges the master link and holds it steady relative to the pry member. In a further refinement of the invention, the coupler includes a center leg insertable between the master link pins.

In accordance with another aspect of the invention, the pry member includes a first post projecting from the support member. The post is arranged to be generally adjacent one end of the master link clip when the coupler is secured to the chain. A second post is also provided in one preferred aspect of the invention. The second post also projects from the support member. The second post is arranged to be generally laterally adjacent an opposite end of the master link clip when the coupler is secured to the chain. Thus, the first pry member is configured to be generally adjacent one end of the master link clip and the second pry member is configured to be generally laterally adjacent an opposite end of the master link clip when the coupler is secured to the chain.

A method of removing a master link from a chain with links is also provided in the present invention. The master link includes two pins with a clip having two ends extending from one pin to the other. The chain links include side plates with pins between the plates and rollers on the pins. The chain has a longitudinal direction along the length of chain. The method includes providing a removal tool having coupler legs and at least one pry post extending from a support member. The position of the pry post is fixed relative to the coupler legs and shifted laterally from them. The coupler legs are inserted between chain rollers such that the legs are aligned longitudinally along the chain and extending through the chain. The pry post is generally laterally adjacent one end of the clip and offset from the legs. A pry member is leveraged between one side of the pry post and one end of the clip to remove the clip from the pins.

In accordance with another aspect of the method the removal tool includes a second pry post. The method further includes reattaching the clip to the pins by leveraging a pry member between the second pry post and the clip until the clip is secured to two pins of the master link.

BRIEF DESCRIPTION OF THE DRAWINGS

Preferred and alternative embodiments of the present invention are described in detail below with reference to the following drawings.

DETAILED DESCRIPTION OF THE PREFERRED EMBODIMENT

Figure 1:
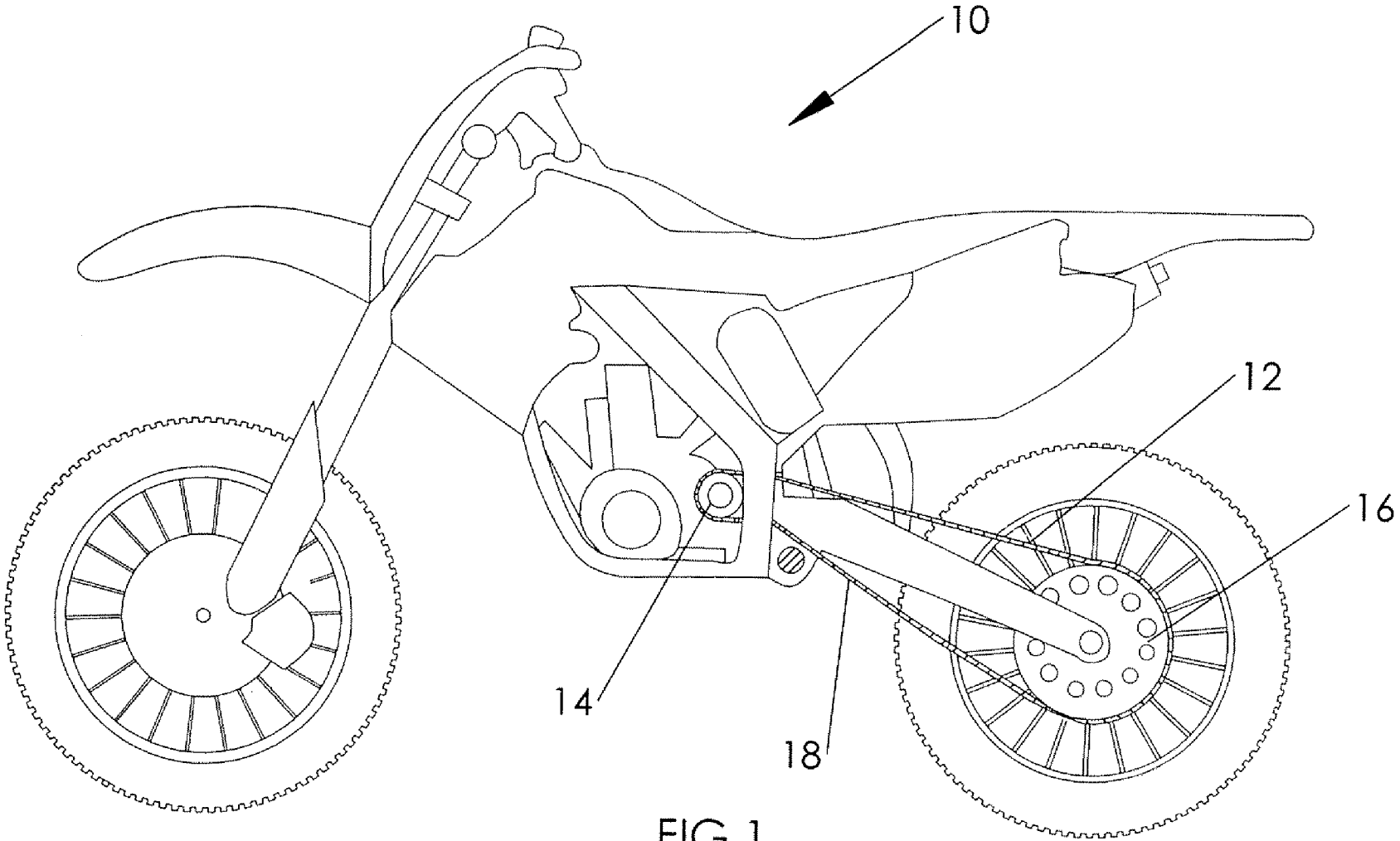
FIG. 1 is a side-elevational view of a motorcycle having a roller type chain.

FIG. 1 illustrates an off-road motorcycle (vehicle 10) that includes a roller type chain 12 secured between a front sprocket 14 and a rear sprocket 16 to transfer the motive force from the counter shaft of the vehicle engine to the rear wheel. This illustrates a typical application of a roller type chain that includes a master link 18 securing the chain in an endless loop around the sprockets 14, 16. Before the chain can be removed from vehicle 10, master link 18 must be removed from chain 12 while chain 12 is on vehicle 10. Thus, the somewhat awkward operation of removing the master link with pliers or a screwdriver must be carried out in this environment.

Figure 2:
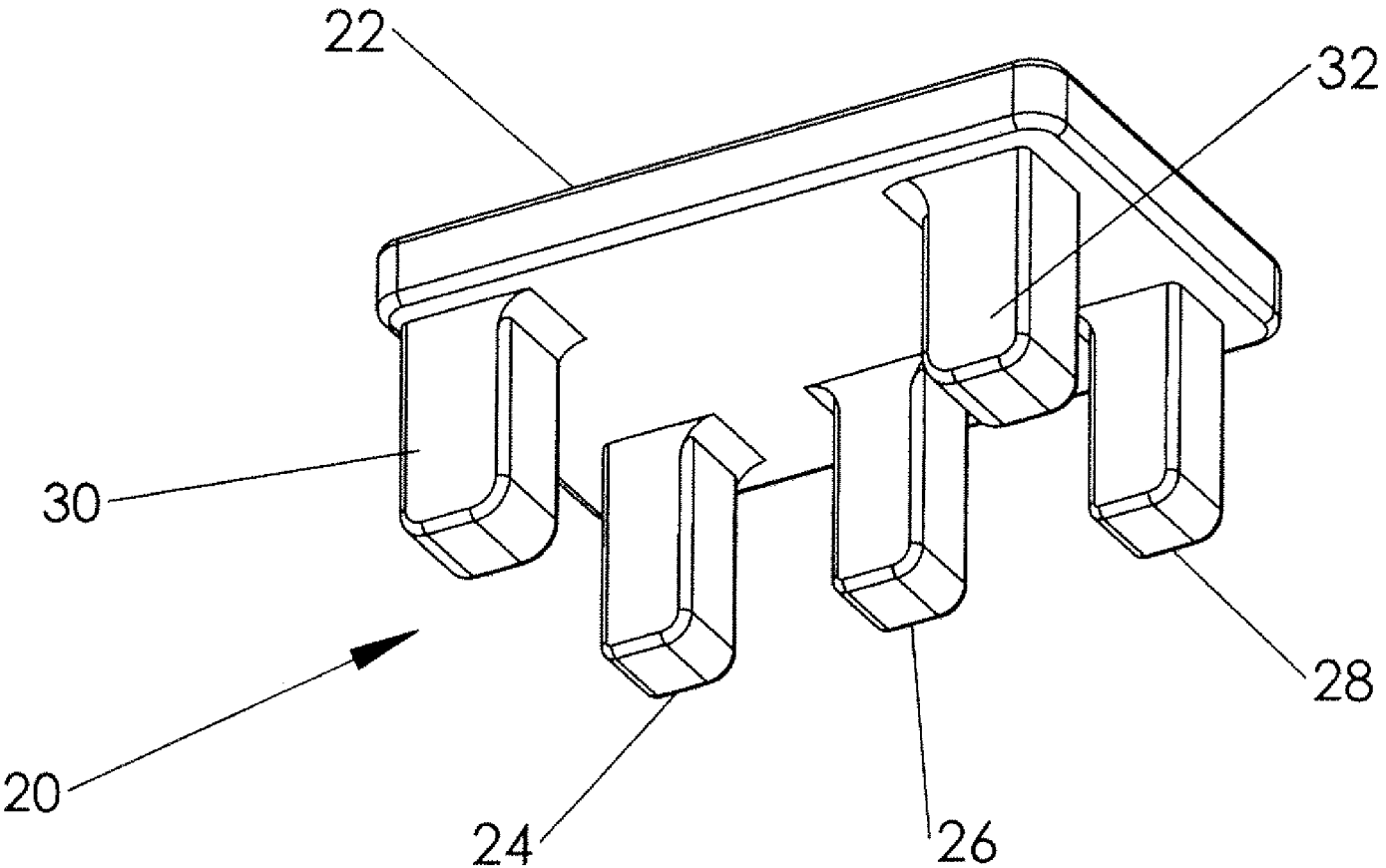
FIG. 2 is an isometric view of the chain tool.

FIG. 2 illustrates a chain tool 20 to make the task of removing chain 12 much simpler. Chain tool 20 includes a top 22, a left leg 24, a middle leg 26, and a right leg 28 all used to secure chain tool 20 to chain 12 as will be discussed in more detail below. A left post 30 and right post 32 also project downwardly from top 22 laterally offset from legs 24, 26, 28.

Top 22 is generally is flat and rectangular in shape. It is thick enough so as to provide adequate support for legs 24, 26, 28 as well as posts 30, 32 such that the legs and posts do not move relative to one another. Top 22 could alternatively be other shapes as long as it holds the spatial relation between the posts and legs. Top 22, posts 30, 32, and legs 24, 26, 28 are preferably formed in an injection molding process as one integral unit. The material used is preferably a plastic such as Delrin®. Other plastics, composites, or even metal may be used to form tool 20. Furthermore, the legs or posts could be separately secured to top 22 or an alternative structure. Legs 24, 26, 28 as well as posts 30, 32 preferably project normal to the lower surface of top 22. The length of the legs and the posts are preferably slightly greater than the thickness of the chain for which they are intended to work. The juncture between the posts and top 22 may have rounded fillets to increase the strength of the connection thereto. Likewise, the junctures between legs 24, 26, 28 may also be rounded with fillets to increase their strength of connection. The rounding between the legs does not affect the insertion of the chain since the chain rollers are rounded and will reside between the legs in the filleted regions as shown in FIG. 3 and discussed below.

Alternatively, a single post may be used with chain tool 20. Likewise, fewer or more legs may be employed in a row to be secured to the chain than is shown in FIG. 2. Even a single leg will provide some support.

Figure 3:
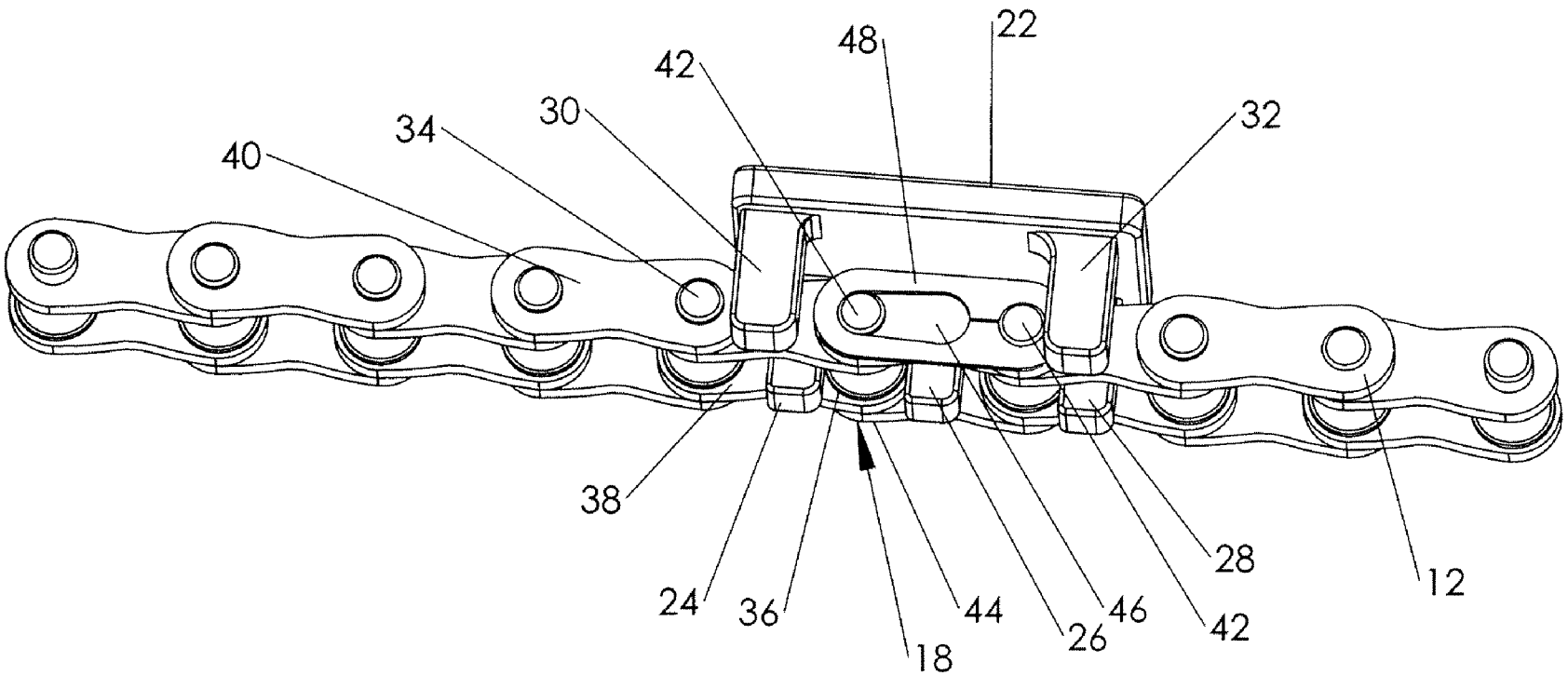
FIG. 3 is an isometric view of the chain tool inserted onto the chain and master link in a position ready for removal of the master link clip.

FIG. 3 illustrates chain tool 20 secured over the top of chain 12 with the legs and top bridging master link 18. As is common with this type of roller chain, chain 12 includes chain pins 34 secured between pin plates 40. Rollers 36 are secured between roller plates 38. These plates, pins, and rollers are secured together as shown to create a roller type chain. The master link connects the ends of the roller type chain to form a continuous loop. A master link includes link pins 42 that extend from a link plate 44 to a removable plate 46. Removable plate 46 is retained on link pins 42 with a clip 48. Clip 48 is typically C-shaped with an opening at one end to be inserted over one of the link pins 42. The ends of link pins 42 include some recesses to engage link clip 48, as is commonly known in the art.

The row of legs are positioned over the top of master link 18 with middle leg 26 projecting down between link pins 42. Legs 24, 26, 28 are pressed between rollers 36 to secure tool 20 to chain 12 around master link 18. Thus, tool 20 secures master link 18 from movement relative to right and left posts 32, 30. Legs 24, 28 also hold the free ends of chain 12 secure from excess movement even with master link 18 completely removed. Thus, they make it easier to insert master link 18 into the free ends of chain 12 during master link insertion. Alternatively, tool 20 may be turned upside down with top 22 providing a base and legs 24, 26, 28, as well as posts 30, 32, projecting upwardly therefrom. In various other applications, the chain may run in alternate orientations and tool 20 could be used in any of those orientations as long as it is inserted between rollers 36. In the preferred embodiment, the cross-section of legs 24, 26, 28 are rectangular in shape such that they fit between adjacent rollers and roller plates 38. A slight interference fit may even be used with a slightly resilient material forming legs 24, 26, 28. In various alternate embodiments, a greater number of legs is used. In other embodiments the legs may be further spread apart such that they are not adjacent the rollers through which link pins 42 extend. Even a single leg may be used in one embodiment with a tight fit between roller plates 38 and rollers 36.

Figure 4:
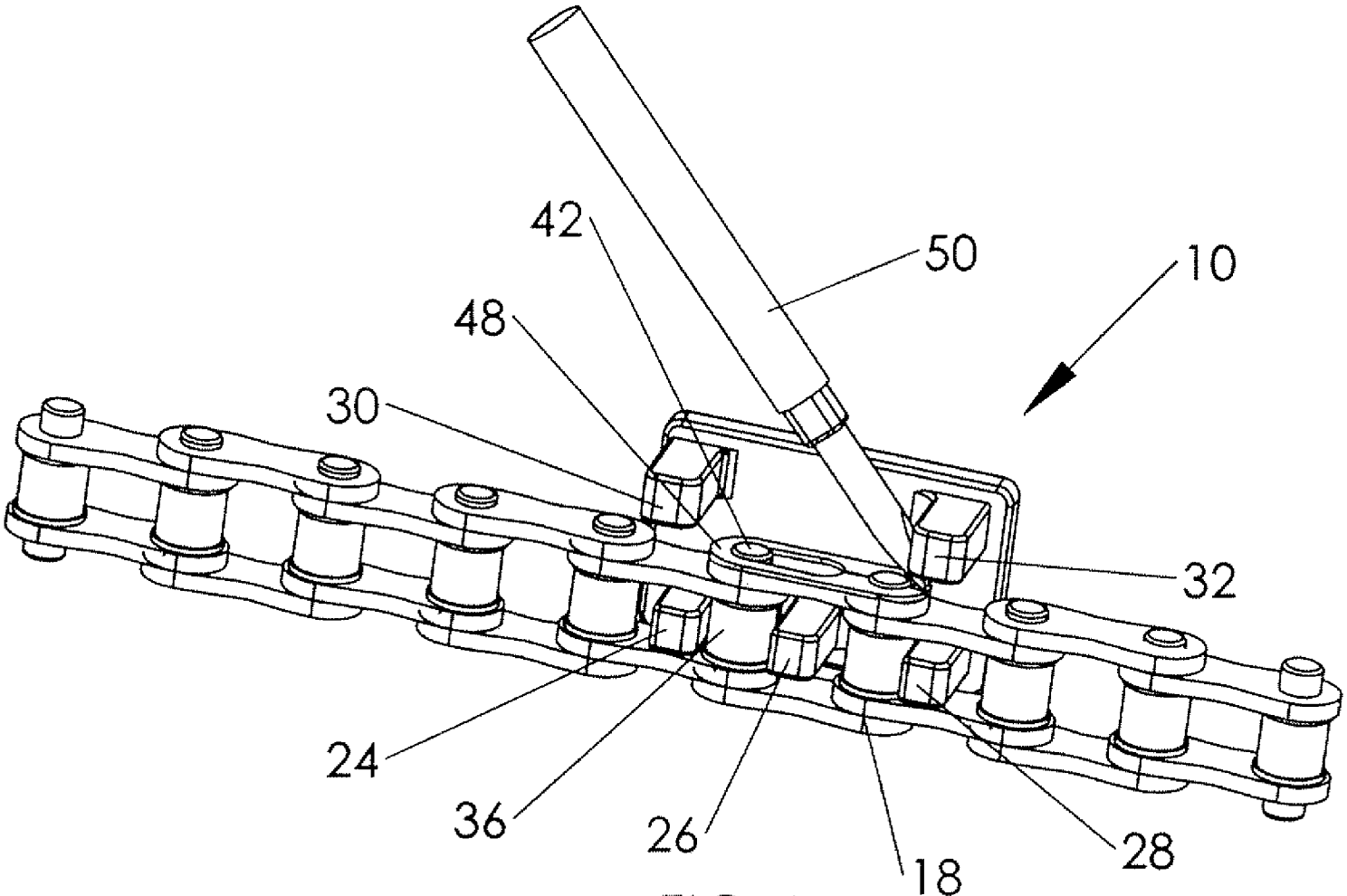
FIG. 4 illustrates the use of a screwdriver to remove the master link clip with the chain tool.

As illustrated in FIG. 4, preferably one of right and left posts 32, 30 is more offset relative to the laterally adjacent right or left legs 28, 24 because more clearance is needed for a screwdriver 50 to be inserted to insert the clip then is required to remove the clip, as shown in FIG. 4.

As seen in FIG. 4 once legs 24, 26, 28 are inserted between rollers 36, a screwdriver may be inserted between right post 32 and the open end of clip 48. It is easy for the mechanic to hold the screwdriver 50 in place since post 32 now does not move appreciably relative to master link 18. A slight force may then be exerted on the end of screwdriver 50 to leverage against clip 48 such that it is removed from the ends of link pins 42.

Insertion of clip 48 onto link pins 42 is carried out by placing clip 48 loosely adjacent pins 42 and prying the closed end of clip 48 with screwdriver 50 leveraged against left post 30. Obviously in these examples the right and left posts may be interchanged depending on the orientation of clip 48.

In other embodiments, tool 10 may have other means for clamping or gripping on to chain 12 preferably in a manner that bridges master link 18. For example, a grip type device may be used with camming mechanism such as is found on certain locking pliers to grip chain 12. In other alternative embodiments posts are omitted but rather a window or gap in the top of tool 10 is used, through which a screwdriver 50 is inserted to be placed adjacent clip 48 and leveraged against the side of the gap or opening.

In each of these cases, the ease of removal or insertion of the clip on the master link and even securing the master link to the chain initially is made easier with the use of the tool.

While the preferred embodiments of the invention have been illustrated and described, as noted above, many changes can be made without departing from the spirit and scope of the invention.

The embodiments of the invention in which an exclusive property or privilege is claimed are defined as follows:

1. A tool for aiding in master link removal from a chain, the master link having two pins and a clip with two ends extending from one pin to the other, the chain having plates and pins, the tool comprising:

a) a support member;

b) a chain coupler extending from said support member, said coupler being securable to the chain adjacent the master link;

c) a pry member held by said support member laterally offset from said chain coupler to be generally adjacent one end of the clip when said coupler is secured to the chain.

2. The tool of claim 1, wherein said coupler includes securement members adapted to bridge the master link, coupling the chain on both sides of the master link.

3. The tool of claim 2, wherein said coupler includes outer legs insertable in the chain adjacent the chain pins, on either side of the master link.

4. The tool of claim 3, wherein the coupler further comprises a center leg insertable between the master link pins.

5. The tool of claim 1, wherein said pry member comprises a first post projecting from said support member arranged to be generally adjacent one end of the master link clip when said coupler is secured to the chain.

6. The tool of claim 5, wherein said pry member further comprises a second post projecting from said support member, said second post arranged to be generally laterally adjacent an opposite end of the master link clip when said coupler is secured to the chain.

7. The tool of claim 6, wherein said coupler includes securement members adapted to bridge the master link, coupling the chain on both sides of the master link.

8. The tool of claim 5, wherein said first post is configured to be generally laterally adjacent one end of the master link clip when said coupler is secured to the chain.

9. The tool of claim 1, further comprising a second pry member held by said support member laterally offset from said chain coupler to be generally adjacent an opposite end of the clip when said coupler is secured to the chain.

10. The tool of claim 9, wherein said first pry member is configured to be generally laterally adjacent one end of the master link clip and the second pry member is configured to be generally laterally adjacent an opposite end of the master link clip when said coupler is secured to the chain.

11. A tool for aiding master link removal from a chain, the master link having two pins and a clip with two ends extending from one pin to the other, the chain having plates, pins, and rollers, the chain having a longitudinal direction along the length of the chain, the tool comprising:

a) a support member;

b) a first coupler leg extending from said support member, said first coupler leg being sized to fit between adjacent chain rollers;

c) a first pry post extending from said support member laterally offset from said first coupler leg to be generally laterally adjacent one end of the clip when said coupler leg is secured to the chain.

12. The tool of claim 11, further comprising a second coupler leg longitudinally offset from said first coupler leg, said second coupler leg being sized to fit between adjacent chain rollers.

13. The tool of claim 11, further comprising a second pry post longitudinally offset from said first pry post, said second pry post being generally laterally adjacent an opposite end of the clip from the first pry post when said first coupler leg is secured to the chain.

14. A method of removing a master link from a chain with links, the master link having two pins an a clip with two ends extending from one pin to the other, the chain links having side plates, with pins between the plates and rollers on the pins, the chain having a longitudinal direction along the length of the chain, the method comprising:

providing a removal tool having chain coupler legs and at least one pry post extending from a support member, the position of the pry post is fixed relative to the coupler legs and shifted laterally from the coupler legs;

inserting the coupler legs between chain rollers such that the legs are aligned longitudinally along the chain with the pry post generally laterally adjacent one end of the clip; and leveraging a pry member between one side of the pry post and one end of the clip to remove the clip from the pins.

15. The method of claim 14, wherein the removal tool includes a second pry post, the method further comprising reattaching the clip to the pins by leveraging a pry member between the second pry post and the clip until the clip is secured to two pins of the master link.

* * * * *